US012173922B2

(12) United States Patent
Kalambe et al.

(10) Patent No.: US 12,173,922 B2
(45) **Date of Patent: *Dec. 24, 2024**

(54) SEQUENTIAL HOT GAS REHEAT SYSTEM IN AN AIR CONDITIONING UNIT

(71) Applicant: Rheem Manufacturing Company, Atlanta, GA (US)

(72) Inventors: Aniket R. Kalambe, Fort Smith, AK (US); Harshad V. Inamdar, Fort Smith, AK (US)

(73) Assignee: Rheem Manufacturing Company, Atlanta, GA (US)

( * ) Notice: Subject to any disclaimer, the term of this patent is extended or adjusted under 35 U.S.C. 154(b) by 161 days.

This patent is subject to a terminal disclaimer.

(21) Appl. No.: 17/498,361

(22) Filed: Oct. 11, 2021

(65) Prior Publication Data

US 2022/0026082 A1 Jan. 27, 2022

Related U.S. Application Data

(63) Continuation of application No. 16/427,805, filed on May 31, 2019, now Pat. No. 11,143,421.

(51) Int. Cl.

| | |
|---|---|
| ***F24F 3/153*** | (2006.01) |
| ***F24F 3/052*** | (2006.01) |
| ***F24F 11/84*** | (2018.01) |

(52) U.S. Cl.

CPC ..... *F24F 3/153* (2013.01); *F24F 3/0525* (2013.01); *F24F 11/84* (2018.01)

(58) Field of Classification Search

CPC ..... F24F 3/153; F24F 11/84; F24F 3/0525

See application file for complete search history.

(56) References Cited

U.S. PATENT DOCUMENTS

| | | | |
|---|---|---|---|
| 3,402,564 A | 9/1968 | Nussbaum | |
| 4,068,494 A | 1/1978 | Kramer | |

(Continued)

FOREIGN PATENT DOCUMENTS

| | | | | |
|---|---|---|---|---|
| EP | 2211123 A1 | * | 7/2010 | ..... F25B 49/02 |
| JP | H0732457 U | * | 6/1995 | |
| JP | 2004020086 A | * | 1/2004 | |

OTHER PUBLICATIONS

Nakatani et al., Dehumidifying Drying Air Conditioner, Jan. 22, 2004, JP2004020086A, Whole Document (Year: 2004).*

(Continued)

*Primary Examiner* — Larry L Furdge

(74) *Attorney, Agent, or Firm* — Eversheds Sutherland (US) LLP

(57) ABSTRACT

A reheat system of an air conditioning unit includes a bypass line that fluidly couples an outlet of a reheat coil to an input end of a metering device. The reheat system includes a reheat exit line that fluidly couples the outlet of the reheat coil to an input of a condenser. A bypass valve is disposed in the bypass line and a reheat valve is disposed in the reheat exit line. A controller is configured to control the bypass valve and the reheat valve such that a refrigerant from the outlet of the reheat coil is routed to the metering device via the bypass line when an ambient temperature is greater than or equal to a cut off temperature value that is indicative of a high ambient temperature condition at which the condenser begins operating as an evaporator.

20 Claims, 4 Drawing Sheets

(56) References Cited

U.S. PATENT DOCUMENTS

| | | | | |
|---|---|---|---|---|
| 4,365,983 | A * | 12/1982 | Abraham | F25B 1/00 62/81 |
| 5,701,753 | A * | 12/1997 | Iritani | B60H 1/3205 62/211 |
| 6,427,461 | B1 | 8/2002 | Whinery | |
| 6,941,770 | B1 | 9/2005 | Taras et al. | |
| 7,028,492 | B2 | 4/2006 | Taras et al. | |
| 11,143,421 | B2 * | 10/2021 | Kalambe | F24F 11/84 |
| 2015/0013356 | A1 | 1/2015 | Karkhanis et al. | |
| 2015/0300714 | A1 | 10/2015 | Ishimura et al. | |
| 2016/0146477 | A1 | 5/2016 | Jewell | |
| 2016/0273815 | A1 * | 9/2016 | Downie | F25B 49/02 |
| 2017/0129311 | A1 | 5/2017 | Li | |
| 2019/0234643 | A1 | 8/2019 | Yamada | |
| 2020/0149754 | A1 * | 5/2020 | K | F24F 3/153 |

OTHER PUBLICATIONS

Sato, Dehumidifier, Jun. 16, 1995, JPH0732457U, Whole Document (Year: 1995).*

Taras, Michael F. "Evaluation of Mechanical Dehumidification Concepts (Part 1)". Purdue University. Purdue e-Pubs. International Refrigeration and Air Conditioning Conference. Jul. 17-20, 2006. pp. 1-7.

Taras, Michael F. "Evaluation of Mechanical Dehumidification Concepts (Part 2)". Purdue University. Purdue e-Pubs. International Refrigeration and Air Conditioning Conference. Jul. 17-20, 2006. pp. 1-9.

* cited by examiner

SEQUENTIAL HOT GAS REHEAT SYSTEM IN AN AIR CONDITIONING UNIT

TECHNICAL FIELD

The present disclosure relates generally to temperature control systems, and more particularly to a hot gas reheat system in temperature control systems, such as in an air-conditioning unit.

BACKGROUND

Temperature control systems such as air-conditioning units are configured to provide temperature regulated and dehumidified air to a conditioned space. Dehumidification is considered as an important feature of air-conditioning units for thermal comfort. To dehumidify the air, air-conditioning units are typically configured with a reheat system that removes the humidity from the air that is supplied to a conditioned space by reheating the air after it has been cooled below a dew point temperature by an evaporator of the air-conditioning units.

A reheat system that is commonly used in air-conditioning units includes a sequential hot gas reheat system which removes the humidity from the air that is supplied to the conditioned space by reheating the air using refrigerant that is re-routed from a compressor to a reheat coil located in an indoor section behind the evaporator and connected sequentially with an input of a condenser. Existing sequential hot gas reheat systems 12 such as the one illustrated in FIG. 1 are generally efficient at low ambient temperatures, however, they become unstable at high ambient temperatures, i.e., when the ambient temperature is greater than the temperature of the refrigerant that is fed to the input of the condenser 120 from the reheat coil 104. For example, when the conventional air-conditioning unit 10 is operating in a dehumidification mode, if the ambient temperature is 110° f. and the temperature of the refrigerant that is fed to the condenser 120 from the reheat coil 104 is 100° F., the condenser 120 will begin to operate as an evaporator. That is, the condenser 120 will start to absorb heat from the ambient air rather than reject heat, which in turn decreases the subcooling. The decrease in subcooling subsequently decreases the evaporator capacity and/or efficiency of the air-conditioning system.

It is noted that this background information is provided to reveal information believed by the applicant to be of possible relevance to the present disclosure. No admission is necessarily intended, nor should be construed, that any of the preceding information constitutes prior art against the present disclosure.

SUMMARY

In one aspect, the present disclosure relates to an air-conditioning unit that includes a compression refrigeration circuit defined by a compressor, a condenser, a metering device, and an evaporator that are arranged in a closed loop. The air conditioning unit includes a sequential hot gas reheat system configured to regulate a moisture content in conditioned air. The sequential hot gas reheat system includes a reheat coil that is disposed adjacent to the evaporator. The reheat coil includes an inlet and an outlet. The inlet is fluidly-coupled to a three-way control valve via a reheat input line and the outlet is fluidly-coupled to a discharge line via a reheat exit line. The discharge line fluidly couples the three-way control valve to the condenser. Another discharge line fluidly couples the three-way valve to the compressor. Further, the sequential hot gas reheat system includes a bypass line that fluidly couples the outlet of the reheat coil to an input end of the metering device. Furthermore, the sequential hot gas reheat system includes a bypass control valve that disposed in the bypass line, a reheat control valve that is disposed in the reheat exit line, and a controller that is communicatively coupled to the bypass control valve and the reheat control valve. The controller is configured to selectively control a flow of refrigerant through the bypass line such that the refrigerant exiting the reheat coil bypasses the condenser to the metering device during a high ambient temperature condition.

In another aspect, the present disclosure relates to a sequential hot gas reheat system of an air conditioning unit that is configured to regulate a moisture in conditioned air supplied by the air conditioning unit. The sequential hot gas reheat system includes a bypass line that fluidly couples an outlet of a reheat coil to an input end of a metering device of the air conditioning unit. The reheat coil is disposed adjacent an evaporator of the air conditioning unit and is configured to regulate the moisture in the conditioned air. Further, the sequential hot gas reheat system includes a reheat exit line that fluidly couples the outlet of the reheat coil to an input of a condenser of the air conditioning unit. Furthermore, the sequential hot gas reheat system includes a bypass control valve that disposed in the bypass line, a reheat control valve that is disposed in the reheat exit line, an ambient temperature sensor that is configured to measure an ambient temperature, and a controller that is communicatively coupled to the bypass control valve, the reheat control valve, and the ambient temperature sensor. The controller is configured to selectively control a flow of refrigerant through the bypass line such that the refrigerant exiting the reheat coil bypasses the condenser to the metering device when the ambient temperature is greater than or equal to a cut-off temperature that is indicative of a high ambient temperature condition.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
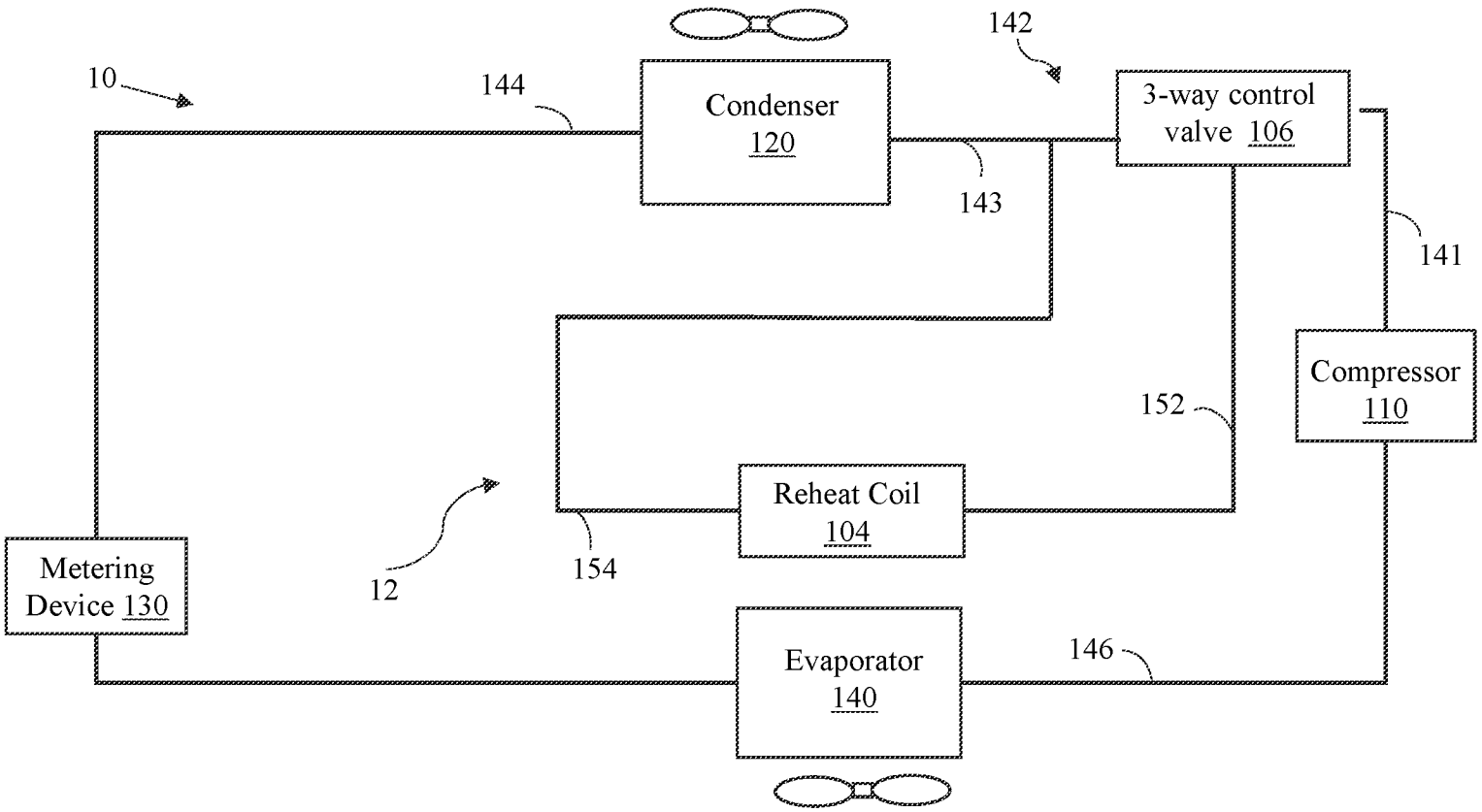
FIG. 1 (PRIOR ART)
FIG. 1 illustrates an air-conditioning unit with a conventional sequential hot gas reheat system, in accordance with an embodiment of a prior art air-conditioning unit.

The drawings illustrate only example embodiments of the present disclosure and are therefore not to be considered limiting of its scope, as the present disclosure may admit to other equally effective embodiments. The elements and features shown in the drawings are not necessarily to scale, emphasis is instead placed on clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes an example air-conditioning unit with an example sequential hot gas reheat system that is configured to provide optimum sub-cooling at high ambient temperatures when the air-conditioning unit operates in a dehumidification mode where a refrigerant of the air-conditioning unit is used to dehumidify indoor air that is supplied to a conditioned space. Before discussing the example embodiments directed to the sequential hot gas reheat system, it may assist the reader to understand the various terms used herein by way of a general description of the terms in the following paragraphs.

The term 'high ambient temperature' may generally refer to any ambient temperature that is greater than or equal to a cut-off temperature at which a condenser of an air-conditioning unit that is disposed outdoors begins to operate as an evaporator. In some example embodiments, the cut-off temperature may be preset. For example, the cut-off temperature may be 100° F. However, in other example embodiments, the cut-off temperature may be determined based on the temperature of the refrigerant at the inlet of the condenser that is disposed outdoors. For example, if the temperature of the refrigerant that is fed to the inlet of the condenser from the reheat coil is 90° F., then the cut-off temperature is 90° F. and any ambient temperature that is >90° F. may be considered as high ambient temperature. In yet another example embodiment, the cut-off temperature may be determined based on the sub-cooling of the refrigerant.

The example sequential hot gas reheat system of the example air-conditioning unit of the present disclosure is configured to bypass the condenser of the air-conditioning unit and exit the sub-cooled refrigerant from a reheat coil to a metering device (e.g., expansion valve) of the air-conditioning unit during high ambient temperatures, i.e., when the ambient temperature is greater than or equal to a cut-off temperature. Bypassing the condenser that is disposed outdoors aids in providing optimum sub-cooled refrigerant to the metering device where the refrigerant undergoes an expansion process before entering the evaporator. The sequential hot gas reheat system uses two control valves (e.g., solenoid or electronic valve) that operate in sync to: (a) bypass the condenser and exit the sub-cooled refrigerant from the reheat coil to the metering device when the ambient temperature is greater than or equal to a cut-off temperature (high ambient temperature conditions), and (b) exit the sub-cooled refrigerant from the reheat coil to the condenser when the ambient temperature is less than the cut-off temperature. The control valves may be controlled based on the ambient temperature alone, the ambient temperature and the temperature of the refrigerant at the inlet of the condenser (or at the output of the reheat coil), and/or a sub-cooling of the refrigerant adjacent an inlet of the metering device.

Example embodiments of an air-conditioning unit with the sequential hot gas reheat system will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the sequential hot gas reheat system of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the sequential hot gas reheat system of the present disclosure can be disposed in an air-conditioning unit that is located in any type of environment (e.g., warehouse, attic, garage, storage, mechanical room, basement) for any type (e.g., commercial, residential, industrial) of user.

Even though the present disclosure describes the sequential hot gas reheat system as being configured for use with an air-conditioning unit, one of skill in the art can understand and appreciate that in other example embodiments, the sequential hot gas reheat system can be used with any other appropriate temperature control systems that operate based on a compression refrigeration cycle without departing from a broader scope of the present disclosure.

Turning now to the figures, example embodiments of a sequential hot gas reheat system will be described in association with FIGS. 2-3. In particular, an example air-conditioning unit with an example sequential hot gas reheat system of the present disclosure will be described in connection with FIG. 2; and an example method of the air-conditioning unit with the sequential hot gas reheat system will be described in connection with FIGS. 3 and 4 by referring to FIG. 2 as needed.

Figure 2:
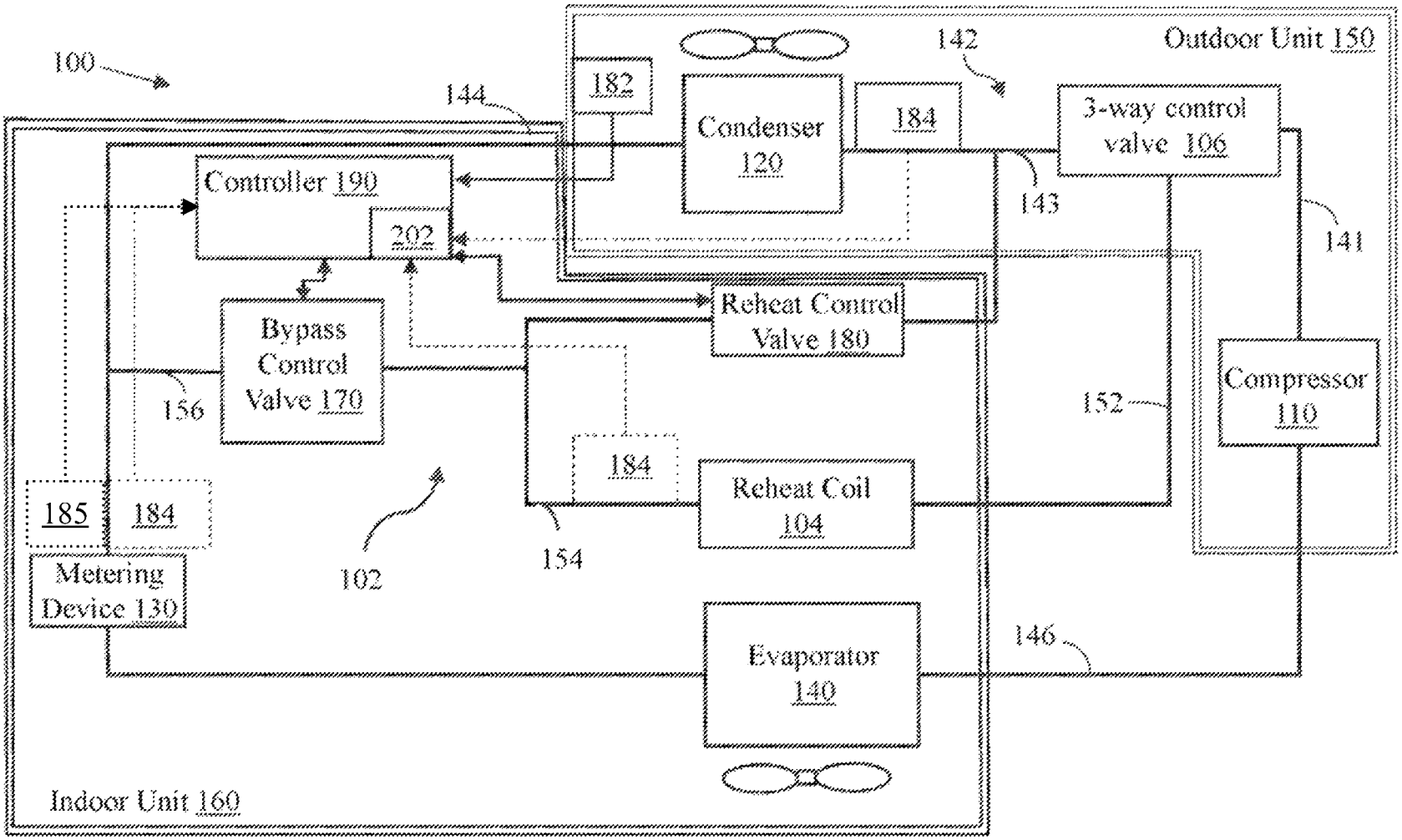
FIG. 2 illustrates an air-conditioning unit with an example sequential hot gas reheat system, in accordance with example embodiments of the present disclosure.
Figure 3:
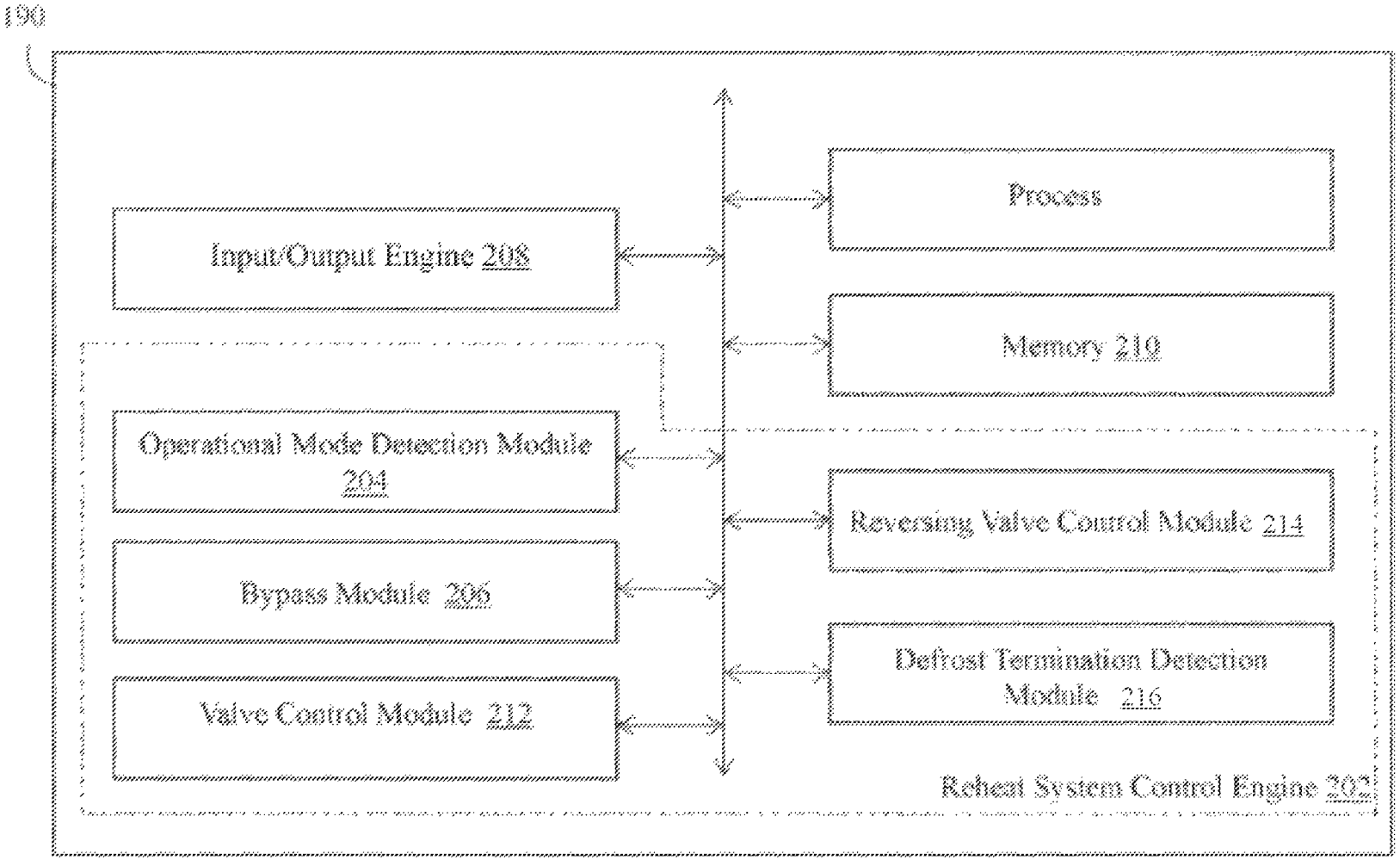
FIG. 3 illustrates example components of a controller of the example air-conditioning unit of FIG. 2 in accordance with example embodiments of the present disclosure.

Referring to FIG. 2, an example air-conditioning unit 100 for providing conditioned air to a temperature-controlled space such as a building may include an indoor unit 160 that is disposed in the building and an outdoor unit 150 that is disposed outside or external to the building. The outdoor unit 150 may include a compressor 110 and an outdoor heat exchanger 120 (hereinafter 'condenser 120'). The compressor 110 may be configured to circulate refrigerant through the air-conditioning unit 100. Further, the indoor unit 160 may include a metering device 130 (e.g., expansion valve) and an indoor heat exchanger 140 (hereinafter 'evaporator'). The outdoor and indoor units (150, 160) and the components (110, 120, 130, and 140) thereof may be coupled to each other using refrigerant lines to form a closed loop. For example, the compressor 110 may be coupled to the condenser 120 via a discharge line 142, the condenser 120 may be coupled to the evaporator 140 through the metering device 130 via a liquid line 144, and the evaporator 140 may be coupled to the compressor 110 via a suction line 146.

Further, the air-conditioning unit 100 may include a sequential hot gas reheat system 102 that includes a correction to provide optimum sub-cooling at high ambient temperature conditions. The sequential hot gas reheat system 102 may include a reheat coil 104 disposed in the indoor unit 150 and is positioned adjacent the evaporator 140 such that air that is to be supplied to the temperature-controlled space passes over the reheat coil after the evaporator and before it is supplied to the temperature-controlled space. The reheat coil 104 may be coupled to the compressor 110 at the input thereof and the condenser 120 at the output thereof. In other words, the reheat coil 104, the compressor 110, and the condenser 120 are connected sequentially or in series, with the reheat coil 104 being disposed between the compressor 110 and the condenser 120.

In particular, the reheat coil 104 is coupled to the compressor 110 via a three-way control valve 106 that is disposed in the discharge line 142 between the compressor 110 and the condenser 120. The discharge line 142 may include a first discharge line 141 and a second discharge line 143. The input of the three-way control valve 106 is coupled to the compressor 110 via the first discharge line 141, a first output of the three-way control valve 106 is coupled to the reheat coil 104 via a reheat input line 152, and the second output of the three-way control valve 106 is coupled to the condenser 120 via the second discharge line 143. Further, the output of the reheat coil 102 is coupled to the condenser 120 via a reheat exit line 154. In one example, the reheat exit line 154 may be connected to the second discharge line 143 that connects the second output of the three-way control valve 106 to the condenser 120. Further, the sequential hot gas reheat system 102 may include a bypass line 156 that couples the output of the reheat coil 104 to the metering device 130. The bypass line 156 is configured to bypass the condenser 120 and connect the reheat coil 104 to the metering device 130 such that the reheat coil 104 is positioned in parallel to the condenser 120.

In other words, unlike the conventional sequential hot gas reheat system that is illustrated in FIG. 1 where the reheat coil is only connected in a series connection with the condenser 120, the sequential hot gas reheat system 102 of the present disclosure connects the reheat coil 104 in series with the condenser 120 via the reheat line (reheat input line 152 and reheat exit line 154) and in parallel with the condenser 120 via the bypass line 156.

In one example embodiment, as illustrated in FIG. 2, the bypass line 156 may be configured to connect the reheat exit line 154 to the liquid line 144. That is, one end of the bypass line 156 may be connected to the reheat exit line 154 and an opposite end of the bypass line 156 may be connected to the liquid line 144. It is noted that the term 'line' as used herein may generally refer to tubes or pipes that are configured to carry refrigerant therethrough and between the different components of the air-conditioning unit 100. For example, the suction line 146 may refer to a copper tube or pipe that is configured to carry refrigerant from the evaporator 140 to the compressor 110. In some example embodiments, one end of the bypass line 156 may be connected to the liquid line 144 and the opposite end of the bypass line 156 may be connected to the output of the reheat coil 104 instead of the reheat exit line 154.

In addition to the reheat coil 104 and the three-way control valve 106, the sequential hot gas reheat system 102 may include two control valves: a bypass control valve 170 that is disposed in the bypass line 156 and configured to control the flow of the refrigerant exiting the reheat coil through the bypass line 156 to the metering device 130 such that the refrigerant flow bypasses the condenser 120, and a reheat control valve 180 that is disposed in the reheat exit line 154 and configured to control a flow of the refrigerant exiting the reheat coil through the reheat exit line 154 to the condenser 120. The two control valves (170, 180) are configured to operate in sync with each other such that as one opens the other closes to provide optimum subcooling at high ambient temperatures. The two control valves (170, 180) may be controlled based on a cut-off temperature that determines the high ambient temperature condition.

In one example embodiment, the bypass control valve 170, the reheat control valve 180, and the three-way control valve 106 may be electronic control valves, however, in other example embodiments, the control valves (170, 180, and 106) may be electromechanical valves, such as solenoid valves.

Further, the sequential hot gas reheat system 102 may include an ambient temperature sensor 182 that is configured to monitor an outdoor ambient temperature where the outdoor unit 150 is disposed, and/or a refrigerant temperature sensor 184 that is disposed on the discharge line 142 adjacent the input of the condenser 120 or on the reheat exit line 154 to monitor a temperature of the refrigerant exiting the reheat coil 104 and/or entering the condenser 120. In some example embodiments, the refrigerant temperature sensor 184 may be disposed on the liquid line 144 adjacent the input of the metering device 130 along with a pressure sensor (not shown in Figures) to determine a subcooling of the refrigerant. In other example embodiments, two temperature sensors may be used, where one is disposed on the liquid line 144 adjacent the input of the metering device 130 to determine the amount of subcooling of the refrigerant, and the other one is disposed on the discharge line 142 at the input of the condenser 120 or on the reheat exit line 154 adjacent the output of the reheat coil 104.

Furthermore, the sequential hot gas reheat system 102 may include a controller 190 that is communicatively and/or electrically coupled to both the control valves (170, 180, 106) and the sensors (182, 184). The controller 190 may be configured to receive temperature data from the sensors (182, 184) (and/or pressure data) and control the control valves (170, 180) based on the ambient temperature, or both the refrigerant temperature of the refrigerant exiting the reheat coil 104 and the ambient temperature, or the subcooling of the refrigerant. The controller 190 may be configured to control the three-way control valve 106 based on a criterion that determines whether the indoor air supplied to the temperature-controlled space is to be dehumidified.

It is noted that the sequential hot gas reheat system 102 may split between the indoor unit 150 and the outdoor unit 160. That is, a portion of the sequential hot gas reheat system 102 may be disposed in the indoor unit 150, while a remainder portion may be disposed in the outdoor unit 160. For example, the reheat coil 104, the bypass line 156, the bypass control valve 170, the reheat control valve 180, and the temperature sensor 184 (if disposed adjacent the metering device 130 or adjacent the output of the reheat coil 104), and the controller 190 of the sequential hot gas reheat system 102 may be disposed in the indoor unit 160, while the three-way valve 106 and the ambient temperature sensor 182 may be disposed in the outdoor unit 160. However, in some example embodiments, the reheat control valve 180 and the temperature sensor 184 (if disposed adjacent discharge line 142) of the sequential hot gas reheat system 102 may be disposed in the outdoor unit 150.

The operation of the sequential hot gas reheat system 102 of the air-conditioning unit 100 will be described below in greater detail in association with FIG. 4 by referring to FIG. 3 which illustrates the various example components of the controller 190 and the reheat system control engine 202 of the controller 190. Reference will also be made to FIG. 2 as needed. The reheat system control engine 202 may include a plurality of modules to control the operation of the air-conditioning unit 100, such as an operational mode detection module 204, a bypass module 206, a valve control module 212, a reversing valve control module 214, and a defrost termination detection module 216. Although specific operations are disclosed in the flowchart illustrated in FIG. 4, such operations are only non-limiting examples. That is, embodiments of the present invention are well suited to performing various other operations or variations of the operations recited in the flowchart. It is appreciated that the operations in the flowchart illustrated in FIG. 4 may be performed in an order different than presented, and that not all the operations in the flowchart may be performed.

Figure 4:
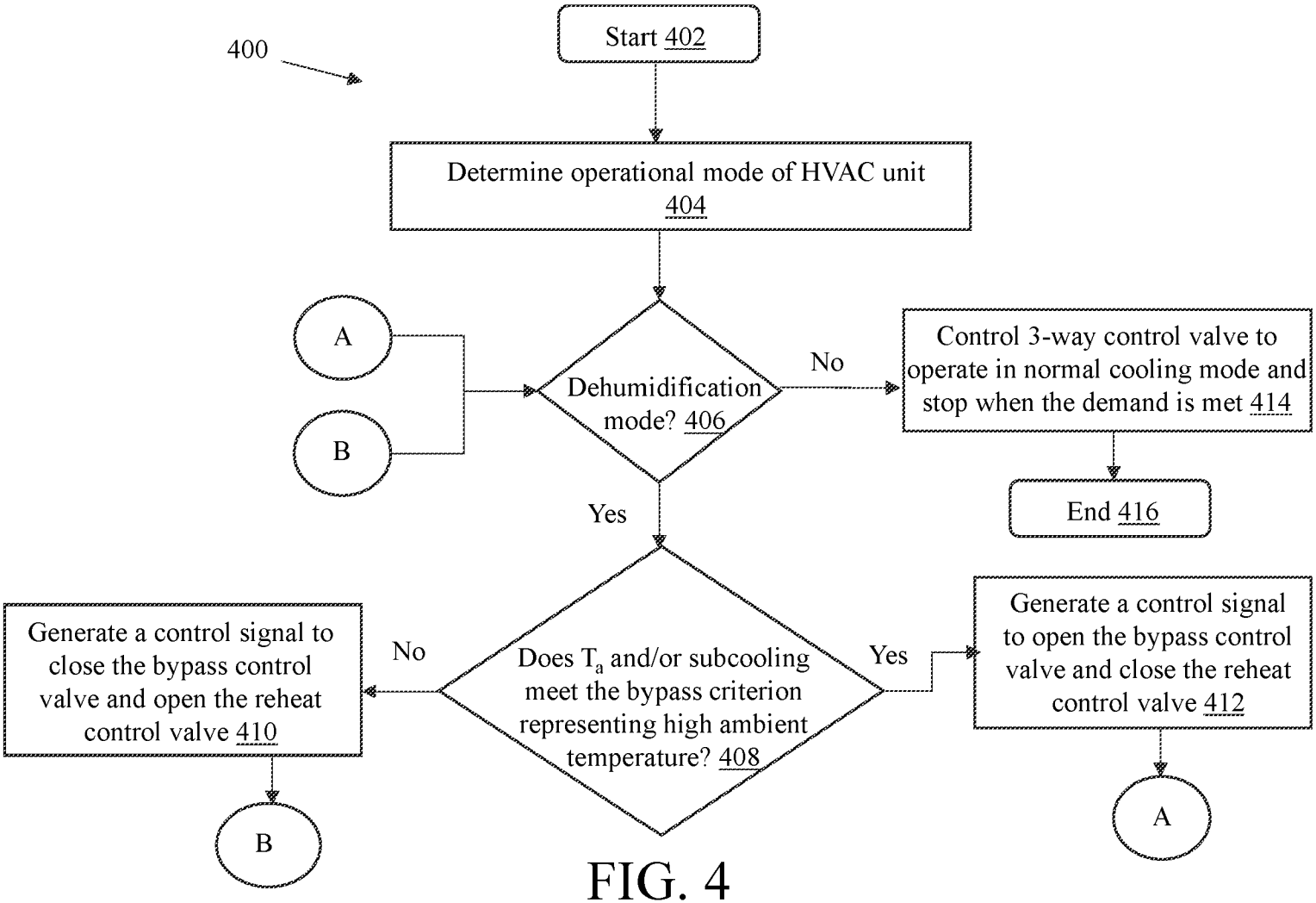
FIG. 4 is a flowchart that illustrates an example operation of the air-conditioning unit with the example sequential hot gas reheat system of FIG. 2, in accordance with example embodiments of the present disclosure.

All, or a portion of, the embodiments described by the flowchart illustrated in FIG. 4 can be implemented using computer-readable and computer-executable instructions which reside, for example, in a memory of the controller 190 or a computer-usable media of a computer system. As described above, certain processes and operations of the present invention are realized, in one embodiment, as a series of instructions (e.g., software programs) that reside within computer readable memory of a computer system and are executed by the processor of the controller. When executed, the instructions cause the controller to implement the functionality of the present invention as described below.

Referring to FIG. 4, the process 400 of air-conditioning unit 100 begins at operation 402 and proceeds to operations 404 and 406. in operations 404 and 406, an operation mode detection module 204 of the reheat system control engine 202 of the controller 190 may determine whether the air-conditioning unit 100 is operating in a standard cooling mode or a cooling mode with dehumidification (hereinafter 'dehumidification mode'). In the standard cooling mode, the three-way control valve 106 may be configured to direct the refrigerant exiting the compressor 110 directly to the condenser 120, while, in the dehumidification mode, the three-way control valve 106 is configured to direct the refrigerant exiting the compressor 110 to the reheat coil 104 to control the humidity of the air that is supplied to the temperature-controlled space.

In one example, digital flags or one or more bits in a memory 210 associated with the controller 190 may be set or removed based on whether the air-conditioning unit 100 is operating in the standard cooling mode or the dehumidification mode. However, in other examples, any other appropriate mechanisms may be used to indicate the operation mode of the air-conditioning unit 100 without departing from a broader scope of the present disclosure. For example, the operation mode of the air-conditioning unit 100 may be determined based on the status of the three-way control valve 106 or based on refrigerant flow detection in the discharge line 142 and/or the reheat input line 152.

Regardless of how the operation mode of the air-conditioning unit 100 is determined by the operation mode detection module 204, in operations 404 and 406, upon determining that the air-conditioning unit 100 is not to be operated in the dehumidification mode, in operation 414, the controller 190 may operate the air-conditioning unit 100 in a standard cooling mode till the demand is met. Responsively, the process 400 ends in operation 416. A standard cooling mode where the air-conditioning unit 100 is configured to supply air at a desired temperature to a temperature-controlled space is well known and will only be briefly summarized herein for the sake brevity and so as not to obscure the operations associated with the sequential hot gas reheat system 102 of the air-conditioning unit 100. In the standard cooling mode of operation, the compressor 110 receives gaseous refrigerant from the evaporator 140 via the suction line 146. The gaseous refrigerant is compressed by the compressor 110 and discharged, at high pressure and relatively high temperature, to the condenser 120 via the three-way control valve 106 and the first and second discharge lines (141, 143). As the refrigerant passes through the condenser 120, heat is transferred from the refrigerant to the ambient air and the refrigerant condenses. The liquid line 144 passes the condensed refrigerant from the condenser 120 to the evaporator 140 through the metering device 130. The refrigerant gains heat and is evaporated as it passes through the evaporator 140. Further, the gaseous refrigerant returns to the compressor 110.

However, in operations 404 and 406, upon determining that the air-conditioning unit 100 is to be operated in a dehumidification mode, the controller 190 proceeds to operation 408. In operation 408, the operation mode detection module 204 may operate in concert with the bypass module 206 of the reheat system control engine 202 and the input/output engine 208 to determine whether the ambient temperature meets a bypass criterion. The bypass criterion may indicate a high ambient temperature condition at which the condenser 120 of the air-conditioning unit 100 begins to operate as an evaporator during the dehumidification mode, which in turn causes the air-conditioning unit 100 to be unstable and affects the efficiency of the air-conditioning unit 100.

In one example embodiment, in operation 408, the bypass module 206 determines if the ambient temperature (Ta) that is received from the ambient temperature sensor 182 via the input/output engine 208 of the controller 190 is greater than a preset cut-off temperature. The preset cut-off ambient temperature may be stored in the memory 210 of the controller 190. If the ambient temperature (Ta) is greater than or equal to the preset cut-off temperature, the bypass module 206 may determine the ambient temperature (Ta) meets the bypass criterion. In another example embodiment, in operation 408, the bypass module 206 determines if the ambient temperature (Ta) is greater than the temperature of the refrigerant (Tr) at either the input of the condenser 120 or the exit of the reheat coil 104. The temperature of the refrigerant (Tr) at either the input of the condenser 120 or the exit of the reheat coil 104 may be received from a refrigerant temperature sensor 184 disposed at the input of the condenser 120 or the exit of the reheat coil 104, respectively. If the ambient temperature (Ta) is greater than the temperature of the refrigerant (Tr) at either the input of the condenser 120 or the exit of the reheat coil 104, the bypass module 206 may determine that the ambient temperature (Ta) meets the bypass criterion.

In some example embodiments, the bypass criterion may not be determined based on the ambient temperature, instead, the bypass criterion may be determined based on the subcooling of the refrigerant. The subcooling may be determined based on the refrigerant temperature and refrigerant pressure in the liquid line 144 adjacent the input of the metering device 130 which may be determined using temperature and pressure sensors disposed on the liquid line 144 adjacent the input of the metering device 130. If the subcooling drops below a preset subcooling value, then, the bypass module 206 may determine that the bypass criteria has been met.

In operation 408, if the bypass module 206 determines that the ambient temperature (or the subcooling) does not meet the bypass criterion, then, in operation 410, the bypass module 206 operates in concert with the valve control module 212 to generate control signals to control the bypass control valve 170 and the reheat control valve 180 such that the refrigerant exiting the reheat coil 104 is directed to the condenser 120. That is, if the bypass module 206 determines that the ambient temperature (or the subcooling) does not meet the bypass criterion, in operation 410, the bypass control module 206 operates in concert with the valve control module 212 to close the bypass control valve 170 and open the reheat control valve 180 which in turn directs the refrigerant from the reheat coil 104 to the condenser 120. However, in operation 408, if the bypass module 408 determines that the ambient temperature (or the subcooling) meets the bypass criterion, then, in operation 412, the bypass module 206 operates in concert with the valve control module 212 to generate control signals to control the bypass control valve 170 and the reheat control valve 180 such that the refrigerant exiting the reheat coil 104 bypasses the condenser 120 and is directed to the metering device 130. That is, if the bypass control module 206 determines that the ambient temperature (or the subcooling) meet the bypass criterion, in operation 412, the bypass control module 206 operates in concert with the valve control module 212 to close the reheat control valve 180 and open the bypass control valve 170 which in turn directs the refrigerant from the reheat coil 104 to the metering device 130 and bypasses the condenser 120. Operations 410 and 412 may continue till the operation mode detection module 204 determines that the operation mode of the air-conditioning unit 100 has changed or there is a change in the ambient temperature or the operation mode of the air-conditioning unit 100 has changed.

The ability to bypass the condenser 120 and exit the refrigerant that has been sub-cooled by the reheat coil 104 directly to the metering device 130 allows the air-conditioning system 100 to maintain an optimum sub-cooling at high ambient temperature conditions. That is, unlike conventional sequential hot gas reheat systems, the sequential hot gas reheat system 102 of the present disclosure allows a stable operation of the air-conditioning unit 100 in the dehumidification mode under both high and low ambient temperatures.

Even though the present disclosure describes the sequential hot gas reheat system 102 as having a control valve in each of the bypass line 156 (bypass control valve 170) and the reheat exit line 154 (reheat control valve 180), one of skill in the art can understand and appreciate that in other example embodiments, the sequential hot gas reheat system may not include the reheat control valve 180. Instead, in some example embodiments, the sequential hot gas reheat system 102 may only include the bypass control valve 180 in the bypass line 156. In said example embodiment where the sequential hot gas reheat system 102 includes only the bypass control valve 180 in the bypass line 156, the refrigerant exiting the reheat coil 104 may be directed to the metering device 130 via the bypass line 156 that bypasses the condenser 120 when the bypass control valve 180 is open. Further, in said example embodiment, the refrigerant exiting the reheat coil 104 may be directed to the condenser 120 via the reheat exit line 154 when the bypass control valve 180 is closed.

Further, in some example embodiments, the reheat system of the present disclosure may be configured as a hybrid hot gas-two phase reheat system (not shown). The hybrid hot gas-two phase reheat system may be substantially similar to the sequential hot gas reheat system 102 of the present disclosure, except that the reheat system may include an additional reheat input line that connects the output of the condenser 120 to the input of the reheat coil 104. Additionally, the controller of the hybrid hot gas-two phase reheat system may be configured to switch between the different reheat modes, i.e., the hot gas reheat mode and the two-phase reheat mode based on various rules or criteria.

Although the present embodiments have been described with reference to specific example embodiments, it will be evident that various modifications and changes may be made to these embodiments without departing from the broader spirit and scope of the various embodiments. For example, the various devices, engines, and modules described herein may be enabled and operated using hardware circuitry (e.g., CMOS based logic circuitry), firmware, software or any combination of hardware, firmware, and software (e.g., embodied in a machine readable medium). For example, the various electrical structures and methods may be embodied using transistors, logic gates, and electrical circuits (e.g., application specific integrated (ASIC) circuitry and/or in Digital Signal Processor (DSP) circuitry).

The terms "invention," "the invention," "this invention," and "the present invention," as used herein, intend to refer broadly to all disclosed subject matter and teaching, and recitations containing these terms should not be misconstrued as limiting the subject matter taught herein or to limit the meaning or scope of the claims. From the description of the exemplary embodiments, equivalents of the elements shown therein will suggest themselves to those skilled in the art, and ways of constructing other embodiments of the present invention will appear to practitioners of the art. Therefore, the scope of the present invention is to be limited only by the claims that follow.

In addition, it will be appreciated that the various operations, processes, and methods disclosed herein may be embodied in a machine-readable medium and/or a machine accessible medium compatible with a data processing system (e.g., a computer system), and may be performed in any order (e.g., including using means for achieving the various operations). Accordingly, the specification and drawings are to be regarded in an illustrative rather than a restrictive sense.

What is claimed is:

1. An air-conditioning unit comprising a compression refrigeration circuit defined by a compressor, a condenser, a metering device, and an evaporator that are arranged in a closed loop, the air conditioning unit further comprising:

a sequential hot gas reheat system configured to regulate a moisture content in conditioned air, the sequential hot gas reheat system comprising:

a reheat coil that is disposed adjacent to the evaporator and comprising an inlet and an outlet, the inlet being fluidly-coupled to a three-way control valve via a reheat input line and the outlet being fluidly-coupled to a discharge line via a reheat exit line, wherein the discharge line fluidly couples the three-way control valve to the condenser, and wherein another discharge line fluidly couples the three-way valve to the compressor;

a bypass line that fluidly couples the outlet of the reheat coil to an input end of the metering device;

a bypass control valve that disposed in the bypass line;

a reheat control valve that is disposed in the reheat exit line; and a controller that is communicatively coupled to the bypass control valve and the reheat control valve to selectively control a flow of refrigerant through the bypass line such that the refrigerant exiting the reheat coil bypasses the condenser to the metering device when an ambient temperature is greater than or equal to a cut-off temperature, wherein the cut-off temperature is a temperature at which the ambient temperature is equal to a temperature of the refrigerant that exits the reheat coil, and wherein the cut-off temperature is indicative of a high ambient temperature condition, and wherein the controller is configured to:

determine that a subcooling of the refrigerant is less than a preset subcooling value; and determine the high ambient temperature condition.

2. The air conditioning unit of claim 1, wherein the high ambient temperature condition is a temperature at or above which the condenser of the air conditioning unit begins to operate to as the evaporator.

3. The air conditioning unit of claim 1, wherein to selectively control the flow of refrigerant through the bypass line, the controller is configured to close the reheat control valve and open the bypass control valve.

4. The air conditioning unit of claim 1, wherein outside of the high ambient temperature condition, the controller is configured to close the bypass control valve and open the reheat control valve such that the refrigerant that exits the reheat coil is routed to and passes through the condenser.

5. The air conditioning unit of claim 1:

wherein the sequential hot gas reheat system further comprises:

an ambient temperature sensor that is configured to measure the ambient temperature, a refrigerant temperature sensor that is configured to measure the temperature of the refrigerant that exits the reheat coil, and wherein the ambient temperature sensor and the refrigerant temperature sensor are communicatively coupled to the controller.

6. The air conditioning unit of claim 5, wherein the controller is configured to determine the cut-off temperature based on the temperature of the refrigerant that exits the reheat coil and the ambient.

7. The air conditioning unit of claim 5, wherein the cut-off temperature is a preset value.

8. The air conditioning unit of claim 5, wherein the ambient temperature sensor is disposed outdoors at an outdoor unit of the air conditioning unit, and wherein the refrigerant temperature sensor is disposed at one of the other discharge line adjacent a refrigerant inlet end of the condenser and the reheat exit line adjacent the outlet of the reheat coil.

9. The air conditioning unit of claim 1:

wherein the sequential hot gas reheat system further comprises a refrigerant temperature sensor and a pressure sensor that are disposed on a liquid line that fluidly couples the condenser to the metering device, wherein the refrigerant temperature sensor and the pressure sensor are disposed adjacent an input end of the metering device and are configured to measure a refrigerant temperature and refrigerant pressure adjacent the input end of the metering device, and wherein the controller is configured to determine the subcooling of the refrigerant based on the refrigerant temperature and the refrigerant pressure adjacent the input end of the metering device.

10. The air conditioning unit of claim 1, wherein the bypass control valve and the reheat control valve are electronic valves.

11. The air conditioning unit of claim 1, wherein the bypass control valve and the reheat control valve are solenoid valves.

12. A sequential hot gas reheat system of an air conditioning unit that is configured to regulate a moisture in conditioned air supplied by the air conditioning unit, the sequential hot gas reheat system comprising:

a bypass line that fluidly couples an outlet of a reheat coil to an input end of a metering device of the air conditioning unit, the reheat coil being disposed adjacent an evaporator of the air conditioning unit and configured to regulate the moisture in the conditioned air, a reheat exit line that fluidly couples the outlet of the reheat coil to an input of a condenser of the air conditioning unit;

a bypass control valve that disposed in the bypass line;

a reheat control valve that is disposed in the reheat exit line;

an ambient temperature sensor that is configured to measure an ambient temperature; and a controller that is communicatively coupled to the bypass control valve, the reheat control valve, and the ambient temperature sensor to selectively control a flow of refrigerant through the bypass line such that the refrigerant exiting the reheat coil bypasses the condenser to the metering device when the ambient temperature is greater than or equal to a cut-off temperature that is indicative of a high ambient temperature condition, wherein the cut-off temperature is a temperature at which the ambient temperature is equal to a temperature of the refrigerant that exits the reheat coil, and wherein the controller is configured to:

determine that a subcooling of the refrigerant is less than a preset subcooling value; and determine the high ambient temperature condition.

13. The sequential hot gas reheat system of claim 12, wherein the reheat coil comprises an inlet that is fluidly coupled to a first output of a three-way control valve of the air conditioning unit and the outlet that is fluidly coupled to a discharge line via the reheat exit line, wherein the discharge line fluidly couples a second output of the three way control valve to the condenser of the air conditioning unit, and wherein an input of the three-way control valve is fluidly coupled to a compressor via another discharge line.

14. The sequential hot gas reheat system of claim 12, wherein to selectively control the flow of refrigerant through the bypass line, the controller is configured to close the reheat control valve and open the bypass control valve.

15. The sequential hot gas reheat system of claim 12, wherein outside of the high ambient temperature condition, the controller is configured to close the bypass control valve and open the reheat control valve such that the refrigerant that exits the reheat coil is routed to and passes through the condenser.

16. The sequential hot gas reheat system of claim 12, wherein the bypass control valve and the reheat control valve are electronic valves.

17. The sequential hot gas reheat system of claim 12, wherein the bypass control valve and the reheat control valve are solenoid valves.

18. The sequential hot gas reheat system of claim 12 wherein the controller is configured to determine the cut-off temperature based on a temperature of the refrigerant that exits the reheat coil and the ambient temperature.

19. The sequential hot gas reheat system of claim 12, wherein the cut-off temperature is a preset value.

20. An air-conditioning unit comprising a compression refrigeration circuit defined by a compressor, a condenser, a metering device, and an evaporator that are arranged in a closed loop, the air conditioning unit further comprising:

a sequential hot gas reheat system configured to regulate a moisture content in conditioned air, the sequential hot gas reheat system comprising:

a reheat coil that is disposed adjacent to the evaporator and comprising an inlet and an outlet, the inlet being fluidly-coupled to a three-way control valve via a reheat input line and the outlet being fluidly-coupled to a discharge line via a reheat exit line, wherein the discharge line fluidly couples the three-way control valve to the condenser, and wherein another discharge line fluidly couples the three-way valve to the compressor;

a bypass line that fluidly couples the outlet of the reheat coil to an input end of the metering device;

a bypass control valve that disposed in the bypass line;

a reheat control valve that is disposed in the reheat exit line; and a controller that is communicatively coupled to the bypass control valve and the reheat control valve to selectively control a flow of refrigerant through the bypass line such that the refrigerant exiting the reheat coil bypasses the condenser to the metering device when an ambient temperature is greater than or equal to a cut-off temperature, wherein the cut-off temperature is a temperature at which a condenser of an air-conditioning unit that is disposed outdoors begins to operate as an evaporator, and wherein the cut-off temperature is indicative of a high ambient temperature condition, and wherein the controller is configured to:

determine that a subcooling of the refrigerant is less than a preset subcooling value; and determine the high ambient temperature condition.

* * * * *